United States Patent [19]

Fischer

[11] 4,423,677

[45] Jan. 3, 1984

[54] ROTARY SHEET OFFSET PRINTING MACHINE

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[21] Appl. No.: 353,230

[22] Filed: Mar. 1, 1982

[30] Foreign Application Priority Data

Mar. 7, 1981 [DE] Fed. Rep. of Germany ..... 3108808

[51] Int. Cl.[3] ..... B41F 13/24

[52] U.S. Cl. ..... 101/232; 101/184

[58] Field of Search ..... 101/232, 247, 182–185, 101/174–175

[56] References Cited

U.S. PATENT DOCUMENTS

| | | | |
|---|---|---|---|
| 2,714,351 | 8/1955 | Koch | 101/184 |
| 3,049,076 | 8/1962 | Ritzerfeld et al. | 101/185 X |
| 3,158,092 | 11/1964 | Barthel | 101/183 X |
| 3,461,798 | 8/1969 | Bulk et al. | 101/184 |
| 3,473,468 | 10/1969 | Vandeman et al. | 101/184 X |
| 3,785,287 | 1/1974 | Dahlgren | 101/184 X |
| 3,916,790 | 11/1975 | Alix | 101/232 |
| 3,918,363 | 11/1975 | Southam | 101/183 |
| 3,946,669 | 3/1976 | Johne et al. | 101/183 X |
| 4,214,526 | 7/1980 | Jeschke | 101/183 |
| 4,222,326 | 9/1980 | Mathes et al. | 101/183 |
| 4,369,705 | 1/1983 | Gelinas | 101/247 X |

FOREIGN PATENT DOCUMENTS

| | | | |
|---|---|---|---|
| 2023510 | 2/1972 | Fed. Rep. of Germany | 101/183 |
| 2905285 | 8/1979 | Fed. Rep. of Germany | 101/182 |
| 2033836 | 10/1979 | Fed. Rep. of Germany | 101/182 |
| 2844418 | 4/1980 | Fed. Rep. of Germany | 101/182 |
| 159920 | 4/1979 | Netherlands | 101/182 |
| 6967123 | 8/1964 | United Kingdom | 101/183 |
| 1002772 | 8/1965 | United Kingdom | 101/182 |

*Primary Examiner*—E. H. Eickholt

*Attorney, Agent, or Firm*—Frishauf, Holtz, Goodman & Woodward

[57] ABSTRACT

To permit double inking of the blanket cylinder (6, 7; 44, 45) of an offset printing machine, in which all the cylinders are the same, and further to permit retrofitting of an existing printing machine, a control unit (C) is connected to the blanket cylinders which are located in movable bearings to engage or disengage the blanket cylinders, in intermittent movement, from a cooperating impression cylinder (8, 9; 46) when a sheet supply apparatus (3, 41) is commanded to feed a sheet only for every other revolution of the printing system, thereby permitting double inking of the blanket cylinder and preventing contact of the inked blanket cylinder with the impression cylinder when no sheet is being fed thereto.

6 Claims, 4 Drawing Figures

ROTARY SHEET OFFSET PRINTING MACHINE

Cross reference to related applications, assigned to the assignee of this application, the disclosure of which is hereby incorporated by reference:

U.S. Ser. No. 353,229, filed Mar. 1, 1982 now as U.S. Pat. No. 4,409,894 Oct. 18, 1983, FISCHER (claiming priority Fed. Rep. Germany No. P 31 08 806.6); U.S. Ser. No. 353,235, filed Mar. 1, 1982 now U.S. Pat. No. 4,414,896 Nov. 15, 1983, FISCHER (claiming priority Fed. Rep. Germany No. P 31 08 807.4);

The present invention relates to offset printing machines and more particularly to a sheet-fed rotary offset printing machine having a sheet supply apparatus, and which is so arranged that the operating conditions of the machine can be readily matched and headed background. A rotary offset printing machine of the type to which the present invention relates has a plate cylinder and at least one rubber or blanket cylinder, continuously in contact with the plate cylinder and further an impression or printing cylinder; all the cylinders have the same diameter. A printing machine of this type is described, for example, in Walenski, "Einführung in den Offsetdruck", pp. 113, 114 and 137 ("Introduction to Offset Printing"). The blanket cylinder is inked once and provides for printing once for each revolution. Many printing jobs can be carried out by a machine of this type, and satisfactory reproduction of printed subject matter is entirely possible. In some instances, however, inking the rubber cylinder once for each impression is not enough; this may occur when the requirements for printed quality are particularly high and if highly viscous ink is used or the printed substrate, typically paper, has an uneven surface.

It has been proposed, see the aforementioned book, page 113, to utilize a blanket cylinder with an impression cylinder of twice the size and which carries a sheet only about half its circumference, the other half of the circumference being set back with respect to the first half. Thus, for each revolution of the printing cylinder, two revolutions of the associated blanket cylinder will result, causing the blanket cylinder to be inked twice. Based on the construction of the machine, however, double inking will necessarily result at all times, even if the particular printing job would not require double inking as such.

THE INVENTION

It is an object to provide a printing machine in which change-over of single, or double inking of the blanket cylinder can be readily accomplished without changing the size or arrangement of the cylinders of the machine, so that, double or sing inking can be controlled as required. For one mode of operation, double inking can be effected. For normal or ordinary operation, the machine can likewise operate with only a single inking step for each passage of a sheet therethrough.

Briefly, the plate cylinder, the blanket cylinder and the printing or impression cylinder all have the same diameter. The machine is associated with a sheet supply apparatus which can be operated in two speed ranges so that, depending on its adjustment, the cylinders will receive a sheet for each revolution or only for every other revolution; if only half the number of sheets, per unit time, are commanded, that is, for every other revolution, the rubber cylinder and the printing cylinder are separated from each other in such a manner that after a sheet has passed between the blanket cylinder and the associated printed cylinder a subsequent free running or free wheeling revolution or cycle is controlled during which the rubber blanket cylinder and the printing or impression cylinder are separated from each other, to permit inking of the blanket cylinder without an impression being printed, or transferred to a sheet of paper.

DRAWINGS

Figure 1:
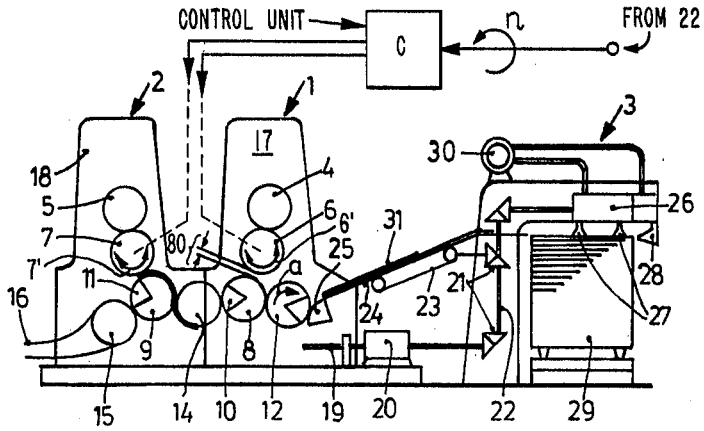
FIG. 1 is a schematic side view of the printing machine arranged to carry out the different printing operations in accordance with the present invention.
Figure 2:
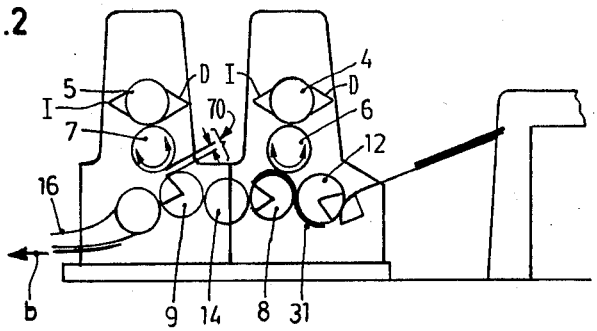
FIG. 2 is a fragmentary view of FIG. 1 in a different operating phase thereof.

Embodiment of FIGS. 1 and 2: A two color sheet offset rotary printing machine in serial construction is illustrated. The machine has two printing stations 1, 2 and a common sheet supply apparatus 3. Each one of the printing stations 1, 2 has a plate cylinder 4, 5, a rubber blanket cylinder 6, 7, and a printing or impression cylinder 8, 9. Inkers I and dampers D associated with the plate cylinders and rubber cylinders 6, 7 are shown only schematically in FIG. 2; they have been omitted from the other Figures of the drawings for clarity. They can be of any suitable and well known construction. The printing cylinders 8, 9 have grooves 10, 11 which retain sheet grippers, not shown in detail and which may be of any well known suitable construction. A sheet supply drum 12, which is also formed with grippers is provided. The printing station 2 includes sprocket wheels 15 which retain a chain conveyor 16 having suitable grippers to transport the printed sheets to a sheet delivery station, not shown and of any suitable and well known construction.

In accordance with the invention, each one of the blanket cylinders 6, 7 is so journaled at the side walls 17, 18 of the printing stations 1, 2 that it can be selectively moved in a curve about the plate cylinders 4, 5 respectively, to assume the positions shown in FIGS. 1 and 2, respectively. Contact with the associated plate cylinders 4, 5 is continuously maintained. Movement of the blanket cylinder 6, 7 in this manner can be readily obtained by journaling the blanket cylinders in bearings which are retained in eccenters positioned in the respective sidewall 17, 18 of the printing stations. Movement of the blanket cylinders, by rotating the eccenters, can be obtained, for example, by hydraulic cylinder-piston arrangements or similar apparatus. The hydraulic positioning piston, or similar apparatus, is operated in timed sequence by an electrical or mechanical control unit C to thereby control the positioning of the respective blanket cylinder 6, 7. A suitable control unit may, for example, be a timer element providing electrical control pulses to open, or close an electrically controlled valve to admit pressurized hydraulic fluid to a hydraulic positioning piston or to drain hydraulic fluid therefrom; a suitable mechanical control unit may be a pushrod operated by a cam. Positioning devices of this type are known, and were used in the past to control introduction of the first sheet from a stack into the printing machine and subsequently thereto to engage the blanket cylinder with the printing cylinder independent of the feeds to the respective printing line. The present invention, thus, can use this portion of the existing equipment, modified merely to be able to carry out the additional function required thereof in accordance with the present invention, which will be described in detail below.

The sheet supply apparatus 3 is driven from a main driveshaft 19 of the machine over a two-stage change gear box 20 and a drive train having bevel wheel gearing therein to provide the right-angle drive, as schematically shown at 21. The drive train 22 is coupled to conveyor belt 23 which supplies sheets over a make-ready table 24 to a gripper pickup 25. The drive train 22 further is connected to transmit rotary power to a sheet lifting or pickup device 26 which has longitudinally movable suction cups or suction grippers 27 and separating jet nozzles 28, to pick up the uppermost sheet from a stack of sheets 29 and supply that uppermost sheet to the make-ready table 24. The sheet pickup device 26 not only includes mechanical means to move the suction cups 27 but, additionally, control means which supply the suction grippers 27 with vacuum for suction and the nozzle 28 with compressed air for separation of sheets. Compressed air and suction, that is, the pneumatic system is supplied from a pump 30. The gear box 20 has a selectable transmission ratio of 1:1 and 2:1.

Operation, with reference to FIGS. 1 and 2:

The printing machine is illustrated for operation for double inking of the blanket cylinder 6, 7. FIG. 1 illustrates the machine at the instant of time in which the gripper pickup apparatus 25 picks up a sheet 31. The blanket cylinder 6 is spaced from the associated printing or impression cylinder, as schematically indicated by the spacing lines 18 A sheet has just entered the printing station 2, and is being printed-on by being passed between the blanket cylinder 7 and the printing or impression cylinder 9, which are in engagement with each other.

Upon rotation of the printing machine from the position shown in FIG. 1, in the direction of the arrow a as shown on the sheet supply drum 12, the gripper pickup 25, will after short movement of the sheet 31 forwardly, transfer the sheet to the gripper of the printing cylinder 8. Upon further rotation of the printing cylinder 8 so that the groove 10 (FIG. 1) thereof will reach a tangential position with respect to the blanket cylinder 6, the blanket cylinder 6 is engaged with the printing cylinder 8, so that the sheet 31 will receive the first impression thereon. After rotation of the cylinder 6 for one revolution, starting from the position shown in FIG. 1, that is, by 360°, the various cylinders will have the position shown in FIG. 2. Upon further rotation of the cylinders, the sheet 31 is transferred to the transport drum 14 which supplies the sheet thereafter to the impression cylinder 9. As soon as the trailing end of the sheet 31 has left the niche between the cylinder 6 and 8, blanket cylinder 6 is disengaged from the impression cylinder 8 in order to prevent smearing or soiling of the surface of the impression cylinder 8 during the subsequent idle or free wheeling phase of the blanket cylinder 6. The blanket cylinder 6, however, remains in continuous contact with the plate cylinder 4 so that, during this idle or free wheeling phase, it can receive an inked impression from the plate cylinder 4.

As soon as the leading edge of the sheet 31 has reached the gap between the cylinders 7 and 9, blanket cylinder 7 is engaged with the impression cylinder 9. Subsequently, and during the passage of the sheet between cylinders 7 and 9, the sheet is printed with the second color. When the leading edge of the sheet 31 reaches chain 16, the grippers thereof receive the sheet and carry the sheet off in the direction of the arrow b to a sheet delivery station (not shown). As soon as the trailing end of the sheet 31 has left the impression line between the cylinders 7 and 9, the blanket cylinder 7 is disengaged from the impression cylinder 9, retaining, however, contact with the plate cylinder 5. During the subsequent free wheeling or idling phase of the blanket cylinder 7, which extends for a full revolution thereof, the blanket cylinder receives an additional inking with the second color. The lifted-off condition of the blanket cylinder 7 is shown schematically by the gap 17 in FIG. 2.

Multiple color printing with double-inking results in the decrease in the number of sheets imprinted on per unit time. The number of sheets, which is half with respect to a single-inking printing is obtained by changing the gearing in gear box 20 to a transmission of 2:1 so that, with respect to the revolutions of the cylinders in the printing machine, only half the number of sheets are supplied by the gripper pickup 25 to the machine system, in comparison to the number of sheets for single-inking operation.

Operation of the machine to carry out ordinary, single-sided two-color printing without double inking is known, so that a description thereof is not necessary.

Figure 3:
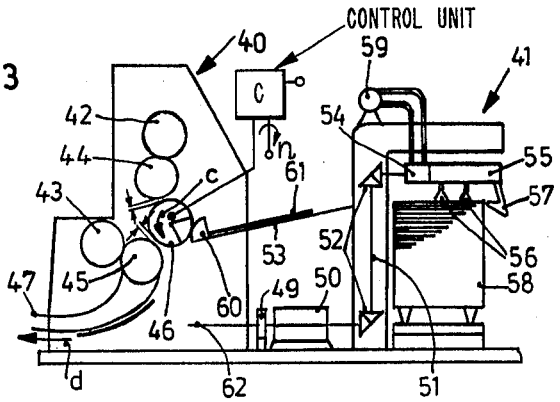
FIG. 3 is a second embodiment of a printing machine.
Figure 4:
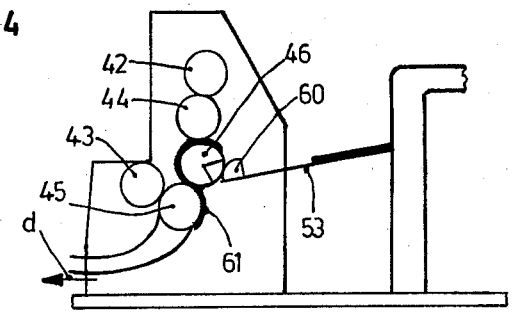
FIG. 4 is a schematic side view of the machine of FIG. 3 in a different operating phase than that of FIG. 3.

Embodiment of FIGS. 3 and 4:

A sheet offset rotary printing machine having a double printing station 40 and a printing supply device 41 is so constructed that two plate cylinders 42, 43 are in continuous rotary engagement with two blanket cylinders 44, 45, cooperating with a common impression cylinder 46. The blanket cylinders 44, 45 can be moved in position with respect to the impression cylinder 46, by eccentrically located bearings or by pivoting levers. The engagement with the associated plate cylinders 42, 43 is maintained. The two ends of the blanket cylinder 45 have a sprocket wheel attached thereto - not shown in detail, which guides a sheet removal chain 46, supplied with grippers to pick up sheets and transport them to the removal station. The inking systems and damping systems associated with the plate cylinders have not been shown and may be of any suitable construction.

A main drive shaft 62 receives driving power over a belt drive 49 from a motor 50. The main drive shaft 62 is connected to a drive train 51 having bevel gears 52 thereon. The drive train 51, similar to the drive train shown in FIG. 1, has branch gearing arrangements which are used to drive transport belts or conveyors of a make-ready table 53 and additionally are connected to a control unit 54 and a sheet lifting apparatus 55 having suction grippers 56 and compressed air nozzles 57. The sheet lifting or separating device 55 operates the suction grippers 56 such that they pick up the uppermost sheet of a stack of sheets 58 and supply that sheet to the make-ready table 53. Suction and compressed air lines extend from the control unit 54 to a pump 59. The control unit 54 controls supply of suction air as well as of compressed air to the suction grippers 56 and to the nozzle 57, respectively, in such a manner that, upon setting of the printing machine to single inking, the suction grippers are connected upon each movement to the suction source, in order to supply a sheet from the stack 58 to the make-ready table 53.

If double-inking is desired, the control unit 54 so controls suction air and compressed separating air that pneumatic suction and blowing air is supplied only upon each second movement of the lifting device 55. Similarly, the compressed air nozzle 57 receives compressed air, in clocked sequence, only when the grippers or suction cups 56 are connected to the source of vacuum. Thus, and with reference to machine operating speed, only half the number of sheets is removed from the stack and supplied to the machine than the number which, at the same operating speed of the machine, is supplied to the make-ready table 53 when normal, single-inking is required or commanded. Pickup grippers 60 transfer the sheet from the make-ready table 53 to the printing cylinder 46.

Operation: Starting from the position of the elements shown in FIG. 3, the printing cylinder 46 is moved in the direction of the arrow c. After a short movement, a sheet 61 is supplied by the pickup 60 thereto and transported to the printing line between the blanket cylinder 44 and the printing cylinder 46. The blanket cylinder 44 is engaged with the printing cylinder 46 just before the leading edge of the sheet 61 reaches the printing or contact line. Printing is effected between the cylinders 44 and 46 with the first color.

As the leading edge of the sheet 61 approaches the blanket cylinder 45, blanket cylinder 45 is engaged with the printing cylinder 46. Immediately thereafter, the grippers of the chain 47 grip the sheet which thereby is transferred from the grippers of the printing cylinder 46. During the following phase of sheet movement between the printing cylinder 46 and the blanket cylinder 45, printing is effected by a second color. When the trailing end of the sheet 61 leaves the printing or impression line between cylinders 44 and 46, the blanket cylinder 44 is returned in the position shown in FIG. 3. The blanket cylinder 44 remains in contact with the plate cylinder 42 and thus is inked thereby. Similarly, as soon as the trailing end of the sheet 61 leaves the printing line between the blanket cylinder 45 and the impression cylinder 46, the blanket cylinder 45 is disengaged from the printing cylinder 46 but remains in contact with the plate cylinder 43 so that the blanket cylinder, during the sequence idling revolution, or idling phase, will receive an additional coating of ink. The gaps between the blanket cylinders 44, 45 and the impression cylinder 46 are, respectively, illustrated by the dimension line between the respective cylinders in FIG. 3, unnumbered, however, for clarity of presentation.

Various changes and modifications may be made, and features in connection with one of the embodiments may be used with the other, within the scope of the inventive concept. Thus, a control unit similar to control unit C (FIG. 1) can be used in the embodiment of FIGS. 3 and 4 to effect respective engagement and disengagement of the blanket cylinder 44, 45 with the impression cylinder 46, coupled and synchronized with operation of the pneumatic control unit 54, and hence also synchronized with the rotation of the respective cylinders. Rotary information is entered in the control unit C (FIG. 1) as schematically indicated by the arrow n derived, for example, from a mechanical connection with the drive train 22.

I claim:

1. Rotary sheet offset printing machine having
a sheet supply apparatus (3, 41);
at least one plate cylinder (4, 5; 42, 43);
at least one rubber blanket cylinder (6, 7; 44, 45) associated with the at least one plate cylinder and, during printing, positioned for continuous contact therewith;
means (I) for supplying ink to the at least one plate cylinder;
and a printing, or impression cylinder (8, 9; 46),
said at least one blanket cylinder and said impression cylinder being relatively shiftable with respect to each other for selective printing engagement or for surface separation, respectively;
wherein, in accordance with the invention,
all said cylinders have the same diameter;
said sheet supply apparatus (3, 41) has two different sheet supply rate settings to supply, for one predetermined cylinder speed, in a first supply setting, a predetermined number of sheets per unit time and, for said same predetermined cylinder speed, in a second supply setting, half the number of predetermined sheets per unit time;
and control means (C) are provided, connected to and controlling the relative position of the at least one blanket cylinder (6, 7; 44, 45) and the printing, or impression cylinder (8, 9; 46) such that
(a) when said sheet supply apparatus is in the second supply setting, the blanket and impression cylinders are moved to a separated position during a first revolution of the cylinders to provide for inking of the blanket cylinder, and the blanket cylinder and the impression cylinder are moved to engaged position during a second or subsequent revolution, to permit double inking of the blanket cylinder from the plate cylinder without transfer of printing information from the blanket cylinder after the first inking, and printing on a sheet during said subsequent revolution,
and
(b) when said sheet supply apparatus is in said first supply setting, the blanket and impression cylinders are in continuous printing engagement to provide for single inking of the blanket cylinder and sheet feed at said predetermined number per unit time.

2. Printing machine according to claim 1, wherein said control means (C) moves the blanket cylinder (6, 7; 44, 45) away from the impression cylinder in movement about the circumference of the associated plate cylinder (4, 5; 42, 43).

3. Printing machine according to claim 1, including a main drive shaft (19) connected to drive the sheet supply apparatus (3);
and a two-step gear change box (20) included in the drive shaft having two transmission ratios of 1:1 and 2:1, respectively.

4. Printing machine according to claim 1, wherein said sheet supply apparatus (41) comprises means for lifting and pickup of a sheet including pneumatic means (55) to lift sheets (61) from a stack (58) of sheets;
and the control means controls the pneumatic device for pneumatic suction application, and hence lifting of the sheet, selectively, for each pickup or lifting movement of said sheet supply apparatus or, selectively, for every other sheet pickup or lifting movement thereof.

5. Printing machine according to claim 4, wherein said control means includes a pneumatic control apparatus.

6. Printing machine according to claim 1, wherein a main drive shaft (19, 62) is provided, coupled to a drive train (21, 52) connected to said sheet supply apparatus and to said printing cylinders;
and wherein said control means (C) operates in synchronism with rotation of said drive train.

* * * * *